US006092311A

United States Patent [19]

MacNamara

[11] Patent Number: 6,092,311

[45] Date of Patent: Jul. 25, 2000

[54] INTERLOCKING FOOTWEAR INSOLE REPLACEMENT SYSTEM

[76] Inventor: Patrick C. MacNamara, 970 Paseo La Cresta, Palos Verdes Estates, Calif. 90274

[21] Appl. No.: 09/245,367

[22] Filed: Feb. 5, 1999

[51] Int. Cl.[7] ..... A43B 3/26; A43B 13/14

[52] U.S. Cl. ..... 36/97; 36/88; 36/99; 36/44; 36/100

[58] Field of Search ..... 36/43, 44, 81, 36/88, 90, 93, 97, 99, 100

[56] References Cited

U.S. PATENT DOCUMENTS

| | | | |
|---|---|---|---|
| 2,327,360 | 8/1943 | Margolin | 36/3 |
| 2,433,329 | 12/1947 | Adler et al. | 36/71 |
| 2,940,187 | 6/1960 | Mitchell | 36/43 |
| 3,186,113 | 6/1965 | Radcliffe et al. | 36/43 |
| 3,442,031 | 5/1969 | Antell | 36/97 |
| 3,952,427 | 4/1976 | Von Den Benken et al. | 36/43 |
| 4,045,886 | 9/1977 | Terasaki | 36/44 |
| 4,510,700 | 4/1985 | Brown | 36/44 |
| 4,727,661 | 3/1988 | Kuhn | 36/100 |
| 4,742,625 | 5/1988 | Sydor et al. | 36/3 R |
| 4,760,654 | 8/1988 | Limbach | 36/43 |
| 4,831,749 | 5/1989 | Tsai | 36/3 B |
| 4,841,648 | 6/1989 | Shaffer et al. | 36/43 |
| 4,848,009 | 7/1989 | Rodgers | 36/137 |
| 4,897,938 | 2/1990 | Otsuka | 36/88 |
| 5,163,237 | 11/1992 | Rosen | 36/97 |
| 5,619,182 | 4/1997 | Robb | 340/479 |

*Primary Examiner*—M D Patterson
*Attorney, Agent, or Firm*—Dimock Stratton Clarizio; Mark B. Eisen

[57] ABSTRACT

Footwear is provided with a series of removable insoles, each being adapted to be detachably installed to the outsole. The insoles have a wearing surface which conforms to the shape of the user's foot, the wearing surface of each insole being configured to accommodate a progressively larger foot size, increasing the useful life of the footwear and optionally eliminating the sockliner. In the preferred embodiment the footwear comprises decorative lights of as many different colors as there are insoles in the series, and each insole is provided with an actuator positioned to activate a specific color of light. Each insole may be colored or color coded to match the color of the lights activated thereby, and can be identified by the color code applied to either the lights or the insoles. The insoles may alternatively be integrated into a single insole with tear-away layers.

3 Claims, 5 Drawing Sheets

INTERLOCKING FOOTWEAR INSOLE REPLACEMENT SYSTEM

FIELD OF THE INVENTION

This invention relates to footwear. In particular, this invention relates to an interlocking insole sizing system for footwear.

BACKGROUND OF THE INVENTION

Footwear typically comprises an outsole bonded or stitched to an upper. Inside the footwear is usually a rigid insole shaped so as to conform as closely as possible to the sole of a user's foot, covered by a sockliner made from a flexible fabric, which increases the user's comfort and the durability of the footwear.

The comfort of the user is largely dependent upon how snugly the footwear fits the user's foot. This in turn depends upon the degree to which the insole conforms to the shape of the user's foot and the size of the space within the upper, which determines how readily the foot can shift positions within the footwear. For an optimum fit, the insole should not only compliment the topography of the sole of the foot, but must also support the periphery of the foot to prevent lateral shifting (and attendant abrasion) within the footwear, and the upper must comfortably maintain the foot in a relatively stable position on the insole. There are many shapes and sizes of feet, and manufacturers accordingly produce footwear in different sizes to accommodate a range of foot sizes and shapes so that, in general, an adult or child can find footwear which will closely and comfortably conform to the shape and size of his or her feet.

However, fitting footwear to children poses a unique problem, because of the rate at which their feet grow. It is generally impractical to purchase footwear that comfortably fits a child's feet at the time of purchase, because the child will quickly outgrow the footwear. Preferring to have their children wear footwear that is too large, rather than footwear that is too small and thus constricts or abrades against the child's feet, parents typically purchase footwear which is too large for the child's feet anticipating that child will grow into the footwear in a short time. In result, children frequently spend prolonged periods wearing footwear that is too large to fit comfortably. This can result in chronic discomfort, and in extreme cases more serious foot ailments.

Moreover, as quickly as a child grows into the footwear he or she will grow out of it, and new footwear must be purchased. Thus, while adults will usually wear out footwear before discarding it, a child's footwear tends to outlast the ability of the footwear to fit the child, so that otherwise usable footwear ends up being discarded or going into disuse.

SUMMARY OF THE INVENTION

The present invention overcomes these disadvantages by providing footwear with a series of removable insoles, each being adapted to be detachably affixed to the outsole. The insoles have a wearing surface which conforms to the shape of the user's foot, the wearing surface of each successive insole in the series being configured to accommodate a progressively larger foot size. Thus as a child's feet outgrow an insole it can be replaced by the next insole in the series, to accommodate the growth of the child's feet while minimizing or eliminating the inevitable discomfort caused by poorly fitting footwear.

In footwear of the invention the useful life of the footwear is considerably increased, since the child can be fitted with footwear which, if supplied with a conventional insole, would be far too large for the child to wear comfortably. By exchanging insoles according to the invention the footwear, although outwardly unchanged, can be periodically adapted to accommodate a progressively larger foot size. Moreover, because each insole is itself used for only a fraction of the life of the footwear, durability of the insole is no longer an issue so the insole can be manufactured from a softer material which in some cases will render a sockliner unnecessary, saving the cost of the sockliner fabric and eliminating a step in the manufacturing process.

In the preferred embodiment the footwear comprises decorative lights, similar to those described in U.S. Pat. No. 4,848,009 issued Jul. 18, 1989 to Rodgers, which is incorporated herein by reference. Preferably the lights are of as many different colors as there are insoles in the series, and each insole is provided with an actuator positioned to activate a specific colour of light. In this fashion the child or a parent can instantly identify which insole is currently in the footwear, at the same time increasing the variety of decorative effects which can be provided by the lights over the life of the footwear. The insoles themselves may be colored, or color coded, to match the color of the lights activated by each respective insole.

The present invention thus provides footwear comprising an outsole and a series of insoles detachable from the outsole, each insole comprising at least one interlocking member for mounting the insole to the outsole and a wearing surface, wherein the wearing surface of each insole differs in size from the wearing surface of other insoles in the series of insoles, such that one insole in the series of insoles can be detached from the outsole and another insole in the series of insoles having a larger wearing surface can be mounted to the outsole so that the footwear accommodates a larger foot.

In a further aspect of the invention the outsole is provided with a plurality of lights of different colors and each insole in the series of insoles is provided with an actuating member cooperating with a switch for activating one particular color of the lights.

BRIEF DESCRIPTION OF THE DRAWINGS

In drawings which illustrate by way of example only a preferred embodiment of the invention.

DETAILED DESCRIPTION OF THE INVENTION

Figure 1A:
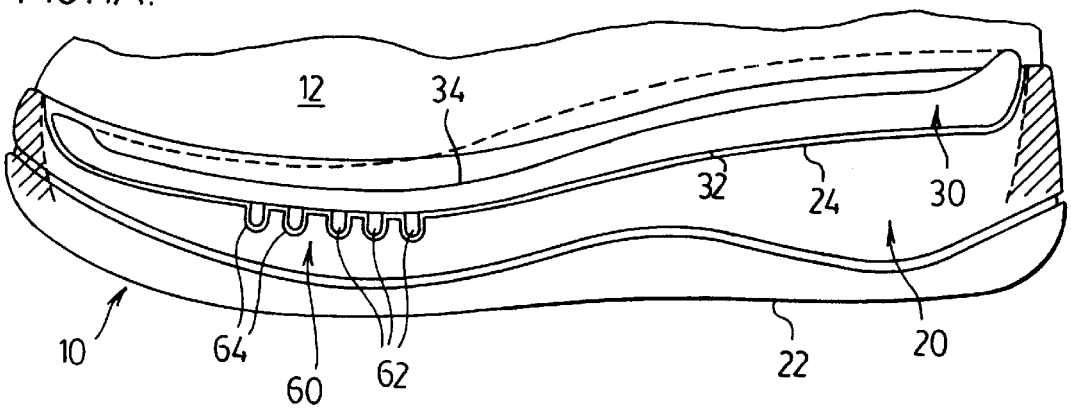
FIGS. 1A, 1B and 1C are partial cross-sectional elevations of footwear respectively embodying insoles configured to accommodate a progressively larger foot size.
Figure 1B:
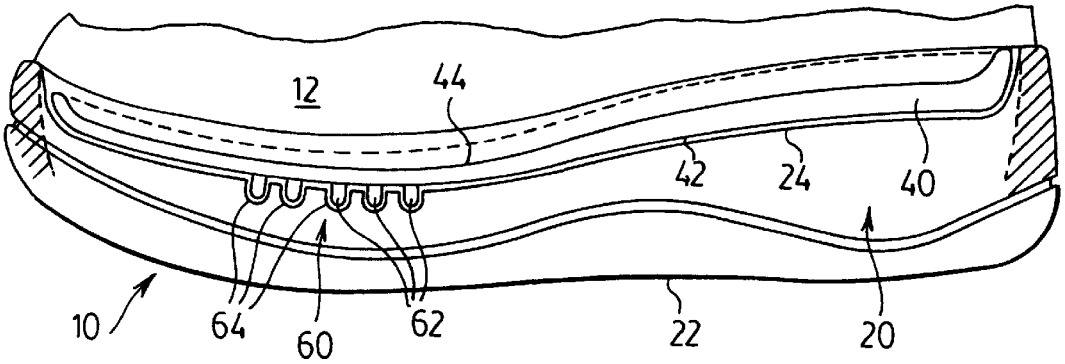
Figure 1C:
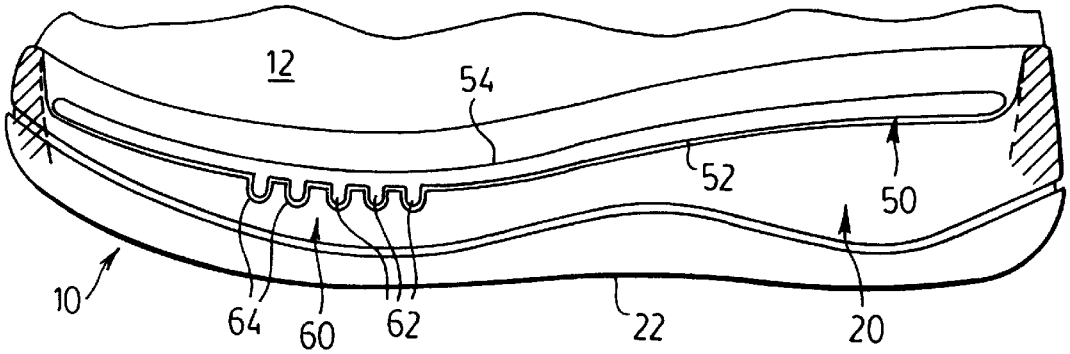

As illustrated in FIGS. 1A, 1B and 1C, footwear 10 embodying the invention comprises an outsole 20 bonded, stitched, vulcanized, injected or otherwise affixed to an upper 12 which may be of conventional design. The outsole 20 and upper 12 are sized to fit the largest foot size intended to be accommodated by the footwear 10, the effective size of the footwear 10 being selectively increased using the insoles of the invention as described below. The outsole 20 has a bottom surface 22 with a tread (not shown) for contacting the ground, and a top surface 24 defined by a periphery of the outsole 20.

It will be appreciated that as used herein reference to the "size" of the footwear is a reference to the size of the foot which the footwear 10 is designed to fit, and relates solely to internal dimensions; the external dimensions of the footwear 10 are determined by the maximum size of the footwear 10 and any aesthetic or stylistic external features which may optionally be applied to the footwear exterior. It will also be appreciated that while the invention is shown and described in relation to athletic shoes, the term "footwear" as used herein can include any other type of footwear 10, including casual and dress shoes, boots, etc.

The footwear 10 includes a series of insoles, in the embodiment illustrated three insoles 30, 40, 50, for varying foot sizes. The insoles 30, 40, 50 may be composed of any suitable material, the preferred construction being a high density foam core which may optionally be covered by a synthetic fabric such as a conventional sockliner fabric and/or treated for moisture and odor resistance, etc. according to conventional treatment methods.

Each insole 30, 40, 50 has a bottom surface 32, 42 and 52, respectively, which is preferably dimensioned to conform to the periphery and configuration of the interior of the outsole 20, and the peripheral configuration of the insoles 30, 40, 50 is thus substantially identical as between all three insoles 30, 40, 50. However, the wearing surface 34, 44, 54 of each insole 30, 40, 50, being the surface which contacts and supports the sole of the user's foot, differs in size and configuration in progressive stages.

Figure 2A:
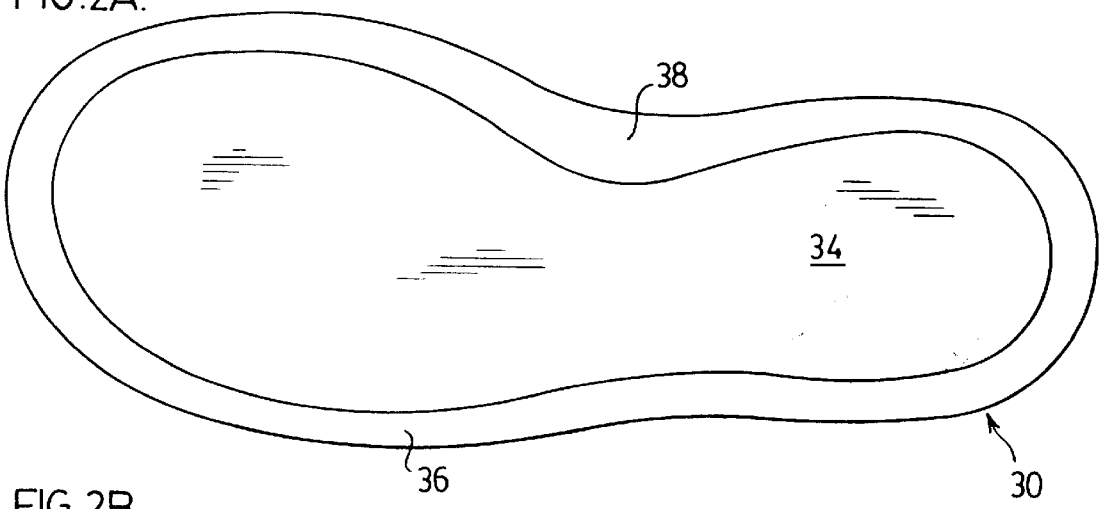
FIGS. 2A, 2B and 2C are top plan views of the insoles respectively illustrated in FIGS. 1A, 1B and 1C, FIGS. 3A, 3B and 3C are partial cross-sectional elevations of the insoles respectively illustrated in FIGS. 1A, 1B and 1C in outsoles having decorative colored lights activated according to the particular insole installed into the footwear.

For example, in the embodiment shown the footwear is designed and dimensioned to fit a maximum size 5 ½ user's foot. The wearing surface 34 of the first insole 30 in the series is configured for a size 5 foot. As shown in FIG. 2A the wearing surface 34 is defined within a side wall 36 and arch support 38 which protrude upwardly from the periphery of the insole 30 to support the periphery of the user's foot. The insole 30 is of a thickness that elevates the size 5 foot within the footwear 10 to the point where the upper 12 comfortably enshrouds the foot and minimizes shifting of the foot within the footwear.

Figure 2B:
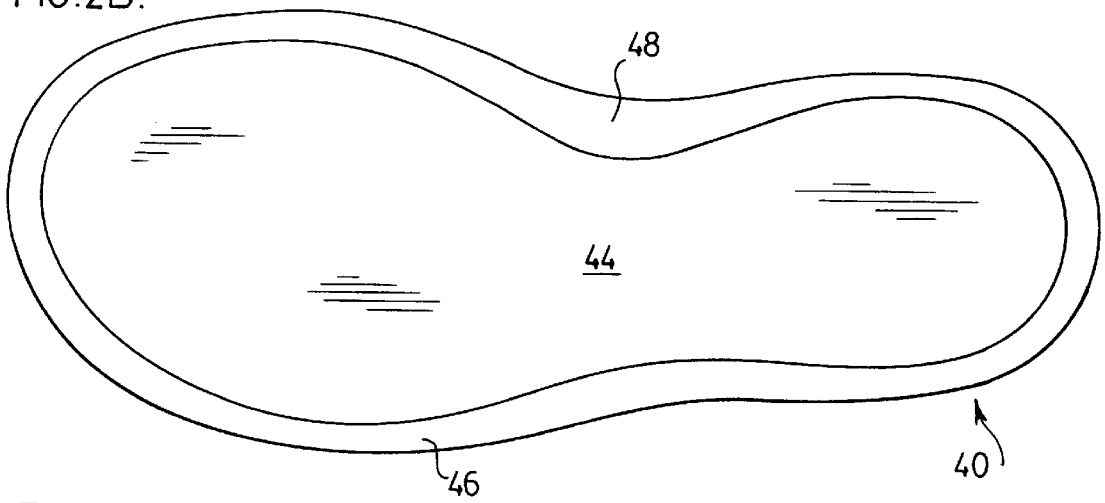
Figure 2C:
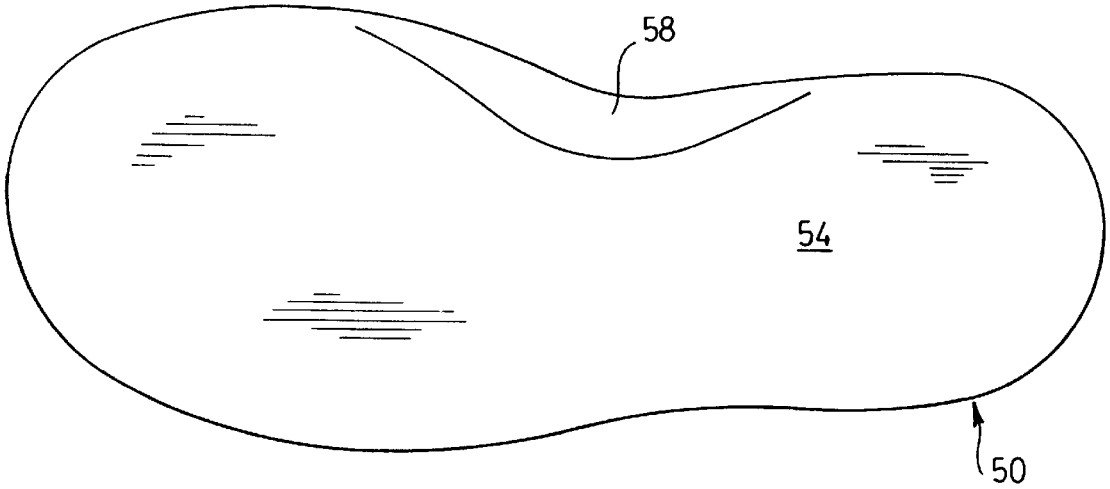

The wearing surface 44 of the second insole 40 in the series is configured for a size 5 ¼ foot. As shown in FIG. 2B the wearing surface 44 is defined within a side wall 46 and arch support 48 which are smaller in both depth and width than the side wall 36 and arch support 38 of the insole 30, to thus increase the effective surface area of the wearing surface 44 relative to the wearing surface 34 to the extent required to accommodate the increased foot size. The insole 40 is also thinner than the insole 30, as seen in FIG. 1B, since the larger foot does not need to be elevated as much within the outsole 20 for the upper 12 to comfortably fit over the user's foot.

Figure 3A:
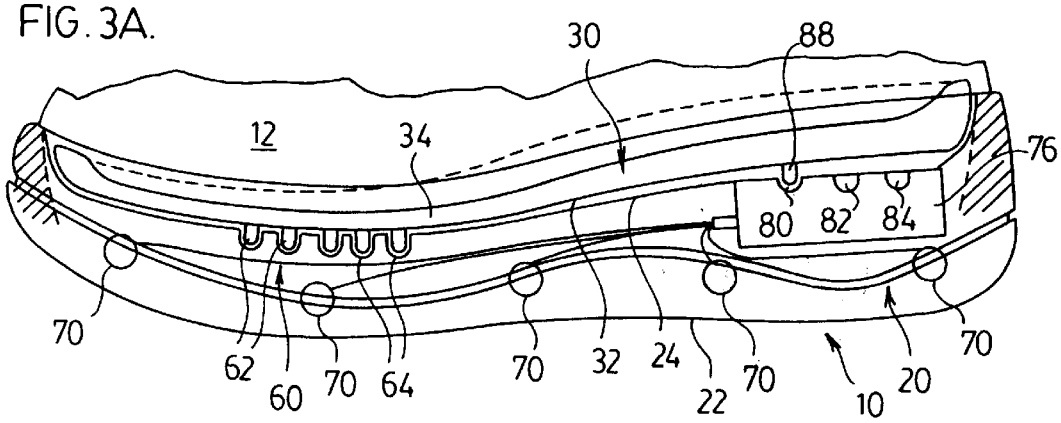
Figure 3B:
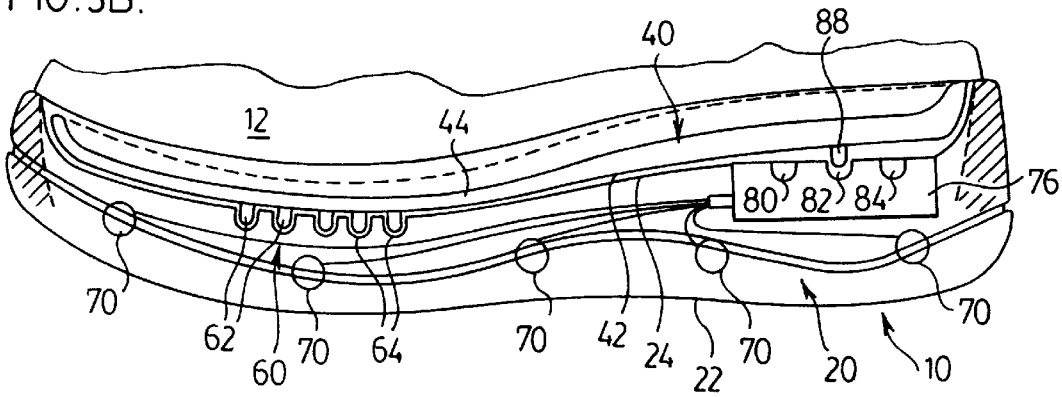

The wearing surface 54 of the third insole 50 in the series is sized for a size 5 ½ foot, which is the largest size intended to be accommodated by the footwear 10. As shown in FIG. 3B the wearing surface 54 extends ever the entire upper portion of the insole 50, there being no side wall (the outsole 20 and upper 12 will provide the necessary support against lateral shifting for a size 5 ½ foot) and a smaller arch support 58 projects from the wearing surface 54. The effective surface area of the wearing surface 54 is thus increased relative to the wearing surface 44 to the extent required to accommodate the increased foot size. The insole 54 is thinner than the insole 44, as shown in FIG. 1C, since the 5 ½ foot size does not need to be elevated in the upper 12 in order for the footwear 10 to comfortably enshroud the user's foot.

The insoles 30, 40, 50 are each detachably affixable to the outsole 20. In the preferred embodiment each insole 30, 40, 50 is provided with one or more interlocking members 60 preferably comprising a plurality of projections 62 protruding from the bottom surface 32, 42 and 52, respectively, of each insole 30, 40, 50, in the region of the ball of the foot. The top surface 24 of the outsole 20 is provided with complimentary sockets 64 for receiving the projections 62 in detachably interlocking relation, preferably by friction fit. The projections 62 are preferably formed integrally with the insole 30, 40 or 50 and are thus composed of high density foam, foam rubber, polyurethane, PVC or the like, which compressively engages into the sockets 64.

The insoles 30, 40, 50 may also be provided with an interlocking member 60 in the heel region as well, for example projections 62 adapted to engage in like fashion into sockets 64 formed in the top surface 24 of the outsole 20, to anchor the heel region of the insole 30, 40 or 50.

In the preferred embodiment each insole 30, 40, 50 is colored or color coded to allow instant visual identification of the particular insole 30, 40 or 50 in use in the footwear 10. For example, the insole 30 may be colored yellow, the insole 40 colored green and the insole 50 colored red; thus, the red insole 50 in use in the footwear 10 indicates that the footwear 10 is in the last stage of use and will have to be replaced.

In the preferred embodiment the outsole 20 is provided with decorative lights 70 in a manner similar to that described in U.S. Pat. No. 4,848,009 issued Jul. 18, 1989 to Rodgers, which is incorporated herein by reference. In the present invention the lights are preferably multi-colored, for example commercially available tri-color LED's capable of emitting light in three colors, which colors correspond to the colors of the insoles 30, 40, 50. Alternatively, groups of monochromatic LED's, light bulbs or the like can be grouped behind a plastic lens or cover to form each light 70, and the LED or light bulb of a color corresponding to the particular insole 30, 40 or 50 mounted in the footwear 10 at any particular time is activated in the manner described below.

Figure 3C:
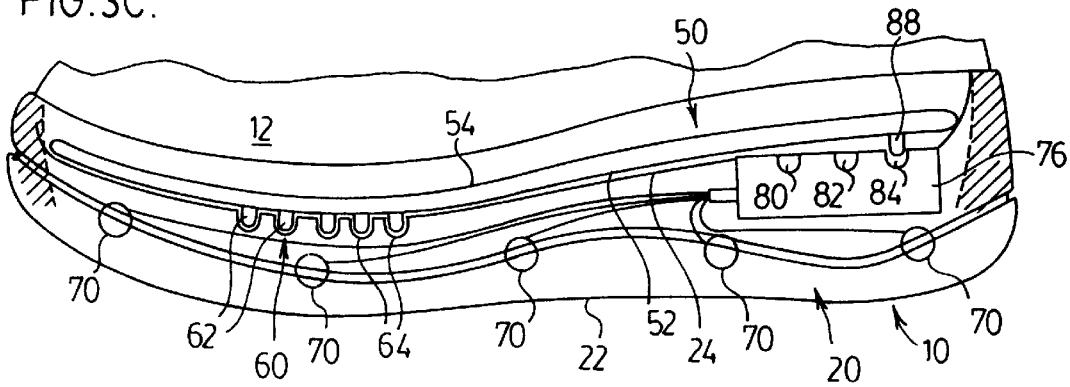
Figure 4A:
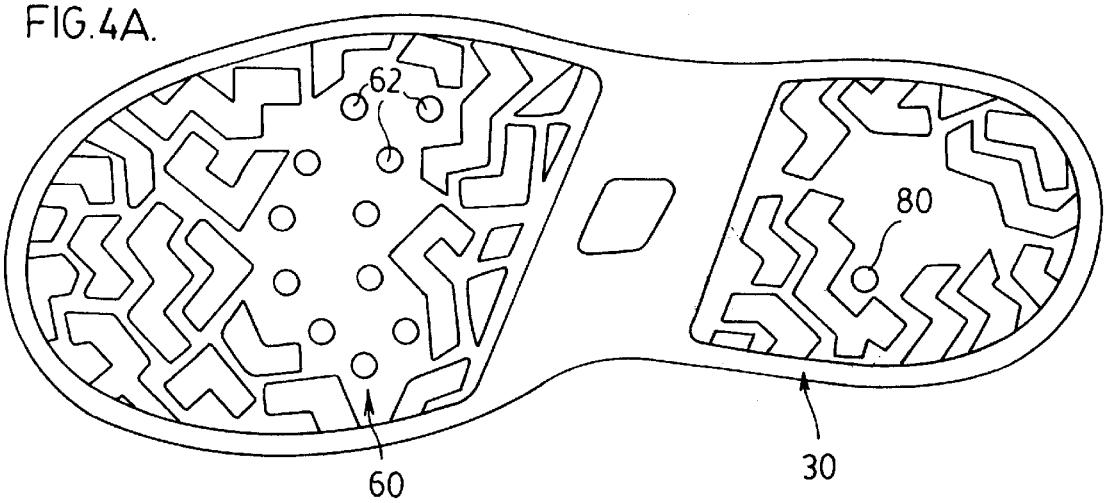
FIGS. 4A, 4B and 4C are bottom plan views of the insoles respectively illustrated in FIGS. 1A, 1B and 1C.
Figure 4B:
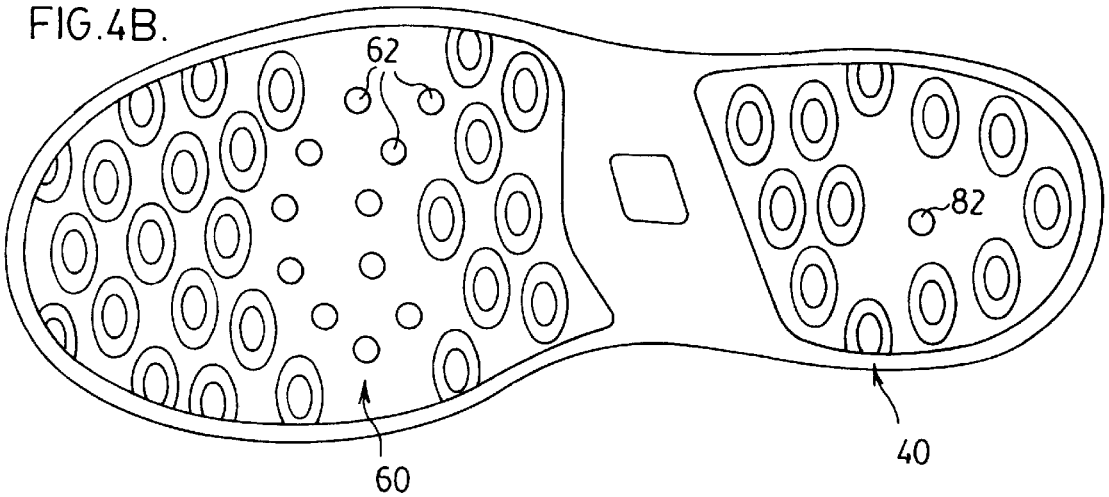
Figure 4C:
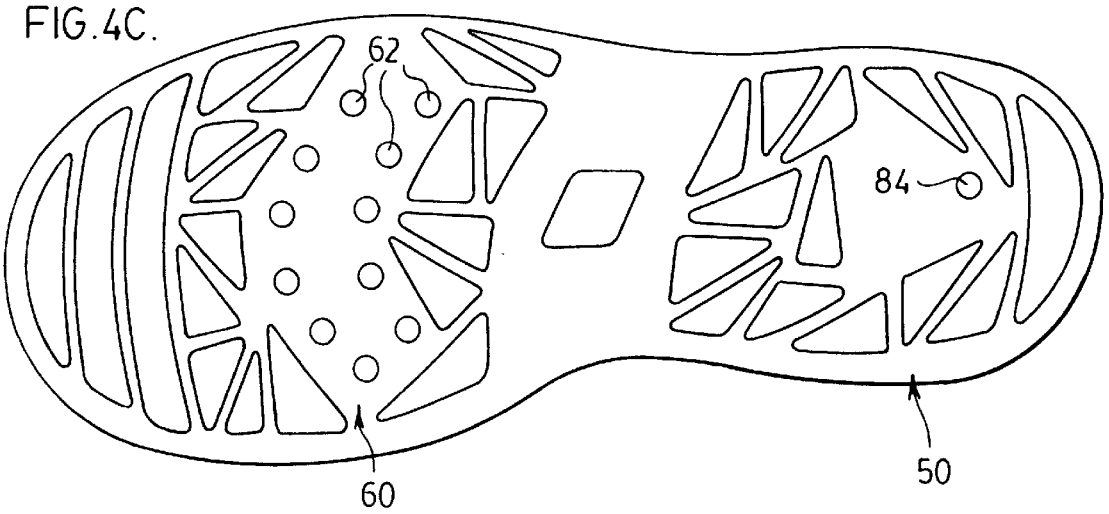

A flashing mechanism 76 such as that described in U.S. Pat. No. 4,848,009 is embedded or affixed to the outsole 20 in the heel region, as shown in FIGS. 3A, 3B and 3C. The flashing mechanism 76 may flash the lights intermittently in response to the a threshold level of pressure exerted on the heel region of the outsole 20, for example when the user is running.

The flashing mechanism 76 is provided with a separate activating switch 80, 82 and 84 for each of the insoles 30, 40, 50, respectively. Each switch 80, 82, 84 is disposed in a different position on the top face of the flashing mechanism 76 and each insole 30, 40, 50 has an actuating member, for example a projection 86, 88 or 90, respectively projecting from the bottom surface 32, 42 or 52 in a position corresponding to the position of the specific switch 80, 82 or 84 that activates the color of light 70 corresponding to the color of the insole 30, 40 or 50 currently in use.

For example, FIG. 3A shows the position of the actuating member 86 projecting from the bottom 32 of the insole 30, colored yellow, which projects into the flashing device 76 to actuate the switch 80 which activates the lights 70 to emit a yellow light; FIG. 3B shows the position of the actuating member 88 projecting from the bottom 42 of the insole 40, colored green, which projects into the flashing device 76 to actuate the switch 82 which activates the lights 70 to emit a green light; and FIG. 3C shows the position of the actuating member 90 projecting from the bottom 52 of the insole 50, colored red, which projects into the flashing device 76 to actuate the switch 84 which activates the lights 70 to emit a red light. Thus, each insole 30, 40, 50 actuates only the switch which causes the lights 70 to emit a color corresponding to the color of the insole 30, 40 or 50. This provides an immediate external visual indication as to which insole 30, 40 or 50 is currently in use in the footwear 10, for example allowing a parent to estimate the time before a new pair of footwear 10 is required for a child.

In an alternate embodiment the actuating members 86, 88, 90 can be disposed on the various insoles 30, 40, 50 in the same position, but provided with different lengths; in this embodiment the actuating switches 80, 82, 84 would be positioned in the same location on the top face of the flashing device 76 but at different depths within the flashing device 76, so that the respective projections 86, 88 or 90 on each insole 30, 40, 50 actuate the switch 80, 82 or 84 that activates the color of lights 70 corresponding to the color of the insole 30, 40 or 50.

Figure 6:
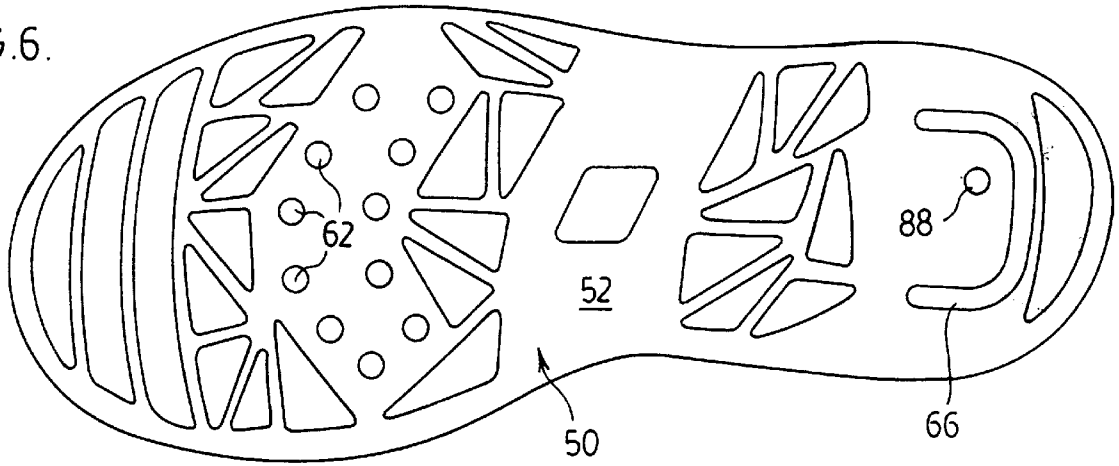
FIG. 6 is a bottom plan view of the insole of FIG. 3C.

In this embodiment the interlocking member 60 in the heel region is adapted to surround the flashing mechanism 76, and helps to retain the flashing mechanism 76 in position. For example, "U"-shaped projection 66 is adapted to engage in like fashion into complimentary socket formed in the top surface 24 of the outsole 20, to anchor the heel region of the insole 30, 40 or 50, as shown in FIG. 6.

In use, for example for use by a child, the footwear 10 is purchased for the child based on the current size of the child's feet and the size of the first stage insole 30, which in this example is colored yellow. The footwear 10 is sold with all three insoles 30, 40, 50 in the series. The insole 30 is detachably mounted to the outsole 20 by aligning the projections 62 with the sockets 64 in the top surface of the outsole 20 and manually depressing the ball region of the insole 30 to set the insole 30 in position in the footwear 10. In the mounted position the actuating projection 86 projects into the flashing device 76 at the position of the switch 80, as shown in FIG. 3A, which activates the lights 70 to emit a yellow light. When the child is wearing the footwear 10, the child's foot is supported by the wearing surface 34 and arch 38 and support against lateral shifting is provided by the side wall 36. In any activity where the pressure on the heel portion of the insole 30 exceeds the threshold pressure for activation of the switch 80, the lights 70 light up or flash yellow, as described in U.S. Pat. No. 4,848,009.

When the child's feet have outgrown the first stage insole 30, the insole 30 is removed by lifting the heel portion of the insole 30 and prying the projections 62 out of the sockets 64, and the second stage insole 40, in this example colored green, is mounted into the footwear 10 in the manner described above. In the mounted position the actuating projection 88 projects into the flashing device 76 at the position of the switch 82, as shown in FIG. 3B, for activating the lights 70 to emit a green light. When the child is wearing the footwear 10, the child's foot is supported by the wearing surface 44 and arch 48 and lateral support against lateral shifting is provided by the side wall 46. In any activity where the pressure on the heel portion of the insole 40 exceeds the threshold pressure for activation of the switch 82, the lights 70 light up or flash green.

When the child's feet have outgrown the second stage insole 40, the insole 40 is removed in the manner described above and the third stage insole 50, in this example colored red, is mounted into the footwear 10 in the manner described above. In the mounted position the actuating projection 90 projects into the flashing device 76 at the position of the switch 84, as shown in FIG. 3C, for activating the lights 70 to emit a red light. When the child is wearing the footwear 10, the child's foot is supported by the wearing surface 54 and arch 58 and lateral support is provided by upper 12. In any activity where the pressure on the heel portion of the insole 50 exceeds the threshold pressure for activation of the switch 84, the lights 70 light up or flash red. This indicates to the parent that the child is using the last stage insole 50, and that when the child's feet outgrow the last stage insole 50 the footwear 10 must be replaced.

Figure 5:
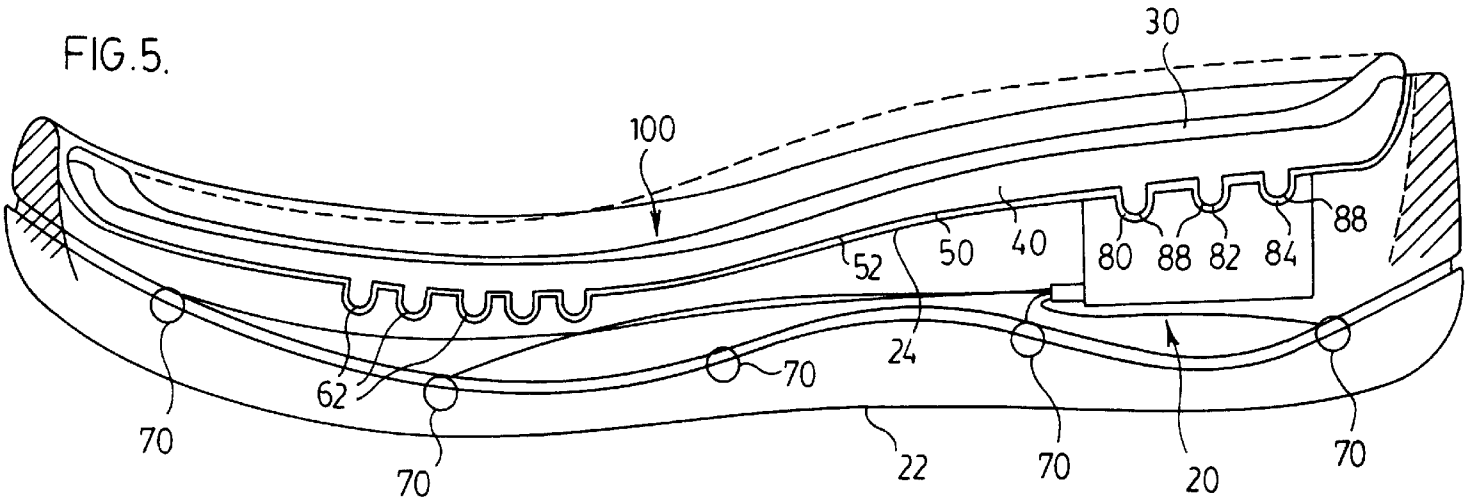
FIG. 5 is a partial cross-sectional elevation of a further embodiment of the invention utilizing integrated insole layers.

In a further preferred embodiment of the invention, illustrated in FIG. 5, the insoles 30, 40 and 50 are integrated as layers into a single insole 100. The layers 30, 40, 50 are detachably affixed together, for example by releasable adhesive. As the user outgrows the first stage insole size, the top layer 30 can be detached as a "tear-away" layer to expose the second stage insole 40, and in like fashion the third stage insole 50 is exposed when the second stage insole 40 is detached. The lights 70 in this embodiment are actuated by a combination of the switches 80, 82, 84. For example, the projection 88 from the fist stage insole 30 extends through the second and third stage insoles 40, 50. The projection 88 from the second stage insole 40 extends through the third stage insole 50. The lights 70 emit yellow light when all three switches 80, 82, 84 are activated; green when only the switches 82, 84 are activated; and red when only the switch 84 is activated.

The current insole size can be identified by the color coded lights or by the color coded insoles, or both. It will be appreciated that the number of insoles and their relative sizes, the colors or color codes used and the particular positions of the interlocking members 60 and actuating members 86, 88, 90 are described and illustrated herein by way of example. These and other features are a matter of selection and are not intended to limit the invention except as expressly set out in the appended claims.

Preferred embodiments of the invention having been thus described by way of example only, it will be apparent to those skilled in the art that certain modifications and adaptations may be made without departing from the scope of the invention. The invention is intended to include all such modifications and adaptations as fall within the scope of the appended claims. first stage insole size, the top layer 30 can be detached as a "tear-away" layer to expose the second stage insole 40, and in like fashion the third stage insole 50 is exposed when the second stage insole 40 is detached. The lights 70 in this embodiment are actuated by a combination of the switches 80, 82, 84. For example, the projection 88 from the first stage insole 30 extends through the second and third stage insoles 40, 50. The projection 88 from the second stage insole 40 extends through the third stage insole 50. The lights 70 emit yellow light when all three switches 80, 82, 84 are activated; green when only the switches 82, 84 are activated; and red when only the switch 84 is activated.

The current insole size can be identified by the color coded lights or by the color coded insoles, or both. It will be appreciated that the number of insoles and their relative sizes, the colors or color codes used and the particular positions of the interlocking members 60 and actuating members 86, 88, 90 are described and illustrated herein by way of example. These and other features arc a matter of selection and are not intended to limit the invention except as expressly set out in the appended claims.

Preferred embodiments of the invention having been thus described by way of example only, it will be apparent to those skilled in the art that certain modifications and adaptations may be made without departing from the scope of the invention. The invention is intended to include all such modifications and adaptations as fall within the scope of the appended claims.

What is claimed is:

1. Footwear comprising an outsole and a series of insoles having substantially identical peripheral configurations and detachable from the outsole, each insole comprising at least one interlocking member for mounting the insole to the outsole, and a wearing surface, wherein the wearing surface of each insole differs in size from the wearing surface of other insoles in the series of insoles, such that one insole in the series of insoles can be detached from the outsole and another insole in the series of insoles having a larger wearing surface can be mounted to the outsole so that the footwear accommodates a larger foot, wherein a periphery of a first insole of the series of insoles is provided with a side wall for supporting a periphery of a user's foot, the wearing surface being defined within the side wall; a periphery of a second insole of the series of insoles is provided with a side wall for supporting a periphery of a user's foot defining a larger wearing surface than the wearing surface of the first insole; and a periphery of a third insole of the series of insoles is provided with a portion of a side wall only about a region of an arch of the third insole, the wearing surface of the third insole being defined by said portion of a side wall and a periphery of the insole.

2. The insole defined in claim 1 wherein an interlocking member is provided in a heel region of the footwear.

3. The insole defined in claim 1 in which the interlocking member comprises a plurality of projections protruding from a bottom surface of the insole complimentary to a plurality of sockets disposed in a top surface of the outsole, and a "U"-shaped projection on the insole in the heel region and a complimentary "U"-shaped socket in an upper surface of the outsole in the heel region.

* * * * *

UNITED STATES PATENT AND TRADEMARK OFFICE

CERTIFICATE OF CORRECTION

PATENT NO. : 6,092,311
DATED : July 25, 2000
INVENTOR(S) : Patrick C. McNamara

It is certified that error appears in the above-identified patent and that said Letters Patent is hereby corrected as shown below:

Title page,
Item [19] should read -- McNamara --
Item [76] the inventor's name should appear as follows, -- Patrick C. McNamara --

Signed and Sealed this

Fifth Day of March, 2002

*Attest:*

*Attesting Officer*

JAMES E. ROGAN
*Director of the United States Patent and Trademark Office*